US006554083B1

(12) United States Patent
Kerstetter

(10) Patent No.: US 6,554,083 B1
(45) Date of Patent: Apr. 29, 2003

(54) ADJUSTABLE BENT HOUSING SUB FOR A MUD MOTOR

(76) Inventor: Scott Kerstetter, 103 Guernsey La., Youngsville, LA (US) 70592

( * ) Notice: Subject to any disclaimer, the term of this patent is extended or adjusted under 35 U.S.C. 154(b) by 0 days.

(21) Appl. No.: 10/006,751

(22) Filed: Dec. 5, 2001

(51) Int. Cl.[7] ..... E21B 7/08
(52) U.S. Cl. ..... 175/61; 175/74; 175/107
(58) Field of Search ..... 175/61, 74, 107

(56) References Cited

U.S. PATENT DOCUMENTS 4,077,657 A * 3/1978 Trzeciak ..... 285/184
4,813,497 A * 3/1989 Wenzel ..... 175/74
5,029,654 A * 7/1991 Wilson et al. ..... 175/74
5,048,621 A * 9/1991 Bailey et al. ..... 175/74
5,052,501 A 10/1991 Wenzel et al.
5,094,305 A 3/1992 Wenzel
5,101,915 A 4/1992 Witte
5,248,004 A * 9/1993 Witte ..... 175/74
5,269,385 A * 12/1993 Sihlis ..... 175/74
5,316,093 A * 5/1994 Morin et al. ..... 175/74
5,343,966 A 9/1994 Wenzel et al.
5,474,334 A * 12/1995 Eppink ..... 285/184
5,479,995 A 1/1996 Falgout, Sr.
5,495,901 A 3/1996 Livingstone et al.

* cited by examiner

*Primary Examiner*—Hoang Dang
(74) *Attorney, Agent, or Firm*—Robert N. Montgomery

(57) ABSTRACT

An adjustable bent housing adapter for downhole mud motor directional drilling operations including a cylindrical housing having a first and a second end defining a central bore there through, the housing being divided into first and second body members, the body members being axially offsetable to one another, said first body member having a mandrel portion insertable along a portion of its length into the bore of the second body member with angularity between the first and second body members achieved by rotational displacement of a first outer indexing sleeve, having non-parallel ends, disposed annularly about the mandrel and a second inner eccentric sleeve also disposed annularly about the mandrel, the inner sleeve having a locking member for connecting to the outer sleeve and being axially movable relative to the mandrel in response to rotation of the outer sleeve, and a locking means provided for securing the outer sleeve to prevent rotation between the outer indexing sleeve and the first body member.

18 Claims, 4 Drawing Sheets

ADJUSTABLE BENT HOUSING SUB FOR A MUD MOTOR

FIELD OF THE INVENTION

This invention relates generally to downhole drilling tools and more particularly to an adjustable bent housing for use with a mud motor for directional drilling.

GENERAL BACKGROUND

Mud motors are used in downhole drilling operations to effect drilling at the bottom of the hole without rotating the drill string. Such mud motors are driven by fluid pressure. Directional drilling using mud motors is achieved by placing a subsection of the drill string tubing, adjacent the mud motor, with a central bore that is offset to the central axis of the drill string to deviate the borehole from vertical to a desired angle. Such subsections are referred to as "Bent housings". These "bent housings" are short sections of pipe or tubing either internally or externally threaded at each end and are "bent" either by physical bending or machined to create an angular offset between the respective ends of the housing. When the "bent housing" is placed in the drill string, the bend in the housing causes the drill string to deviate from vertical as drilling progresses. More recently the industry has come to rely on a single bent housing on which the angle can be adjusted. The angle of the present housing is adjusted prior to insertion into the well and remains fixed until withdrawn and readjusted. Housings of this type are therefore referred to as "surface adjustable" bent housings to distinguish them from housings that are "downhole adjustable", that is, adjustable while in the well bore without being withdrawn to the surface.

Although the terms "subs" and "housings" are sometimes used synonymously, a "sub" is typically a bent section installed in the drill string above the downhole motor/bearing assembly/drill bit combination used in the directional drilling of well bores. A "housing", on the other hand, fits between the motor and the bearing assembly and, in addition to providing bend, it also accommodates a drive shaft connecting the motor to the bearing assembly/drill bit through its central bore. The present invention is intended for use primarily as an adjustable bent "housing".

SUMMARY OF THE INVENTION

The present invention represents an adjustable bent housing structure for downhole mud motor directional drilling operations. According to the present invention, there is provided an adjustable bent housing for a downhole mud motor that includes a cylindrical housing having a first and a second end defining a central bore there through, the housing being divided into first and second body members, the body members being axially offsetable to one another said first body member having a mandrel portion insertable along a portion of its length into the bore of the second body member with angularity between the first and second body members achieved by rotational displacement of a first outer sleeve, having non-parallel ends, disposed annularly about the mandrel, and a second inner eccentric sleeve, also disposed annularly about the mandrel, the inner sleeve having a locking member for connecting to the outer sleeve and being axially movable relative to the mandrel in response to rotation of the outer sleeve, and a setting means provided for securing the outer sleeve to prevent relative rotation between the outer collar and the first body member.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
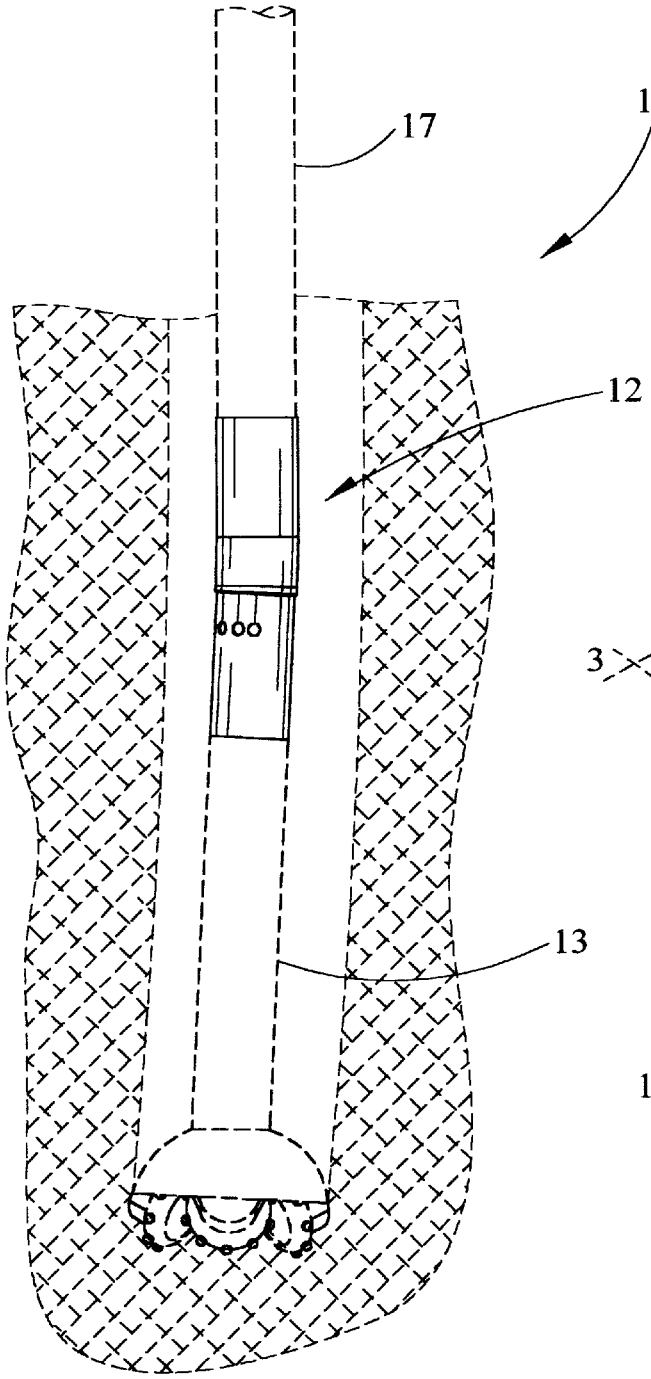
FIG. 1 is cross section view of the preferred embodiment in use with mud motor downhole.

Looking first at FIG. 1, we see the bent housing sub assembly 12 located in the mud motor assembly 10 between the drill bit and bearing assembly 13 and the mud motor power unit 17.

Figure 2:
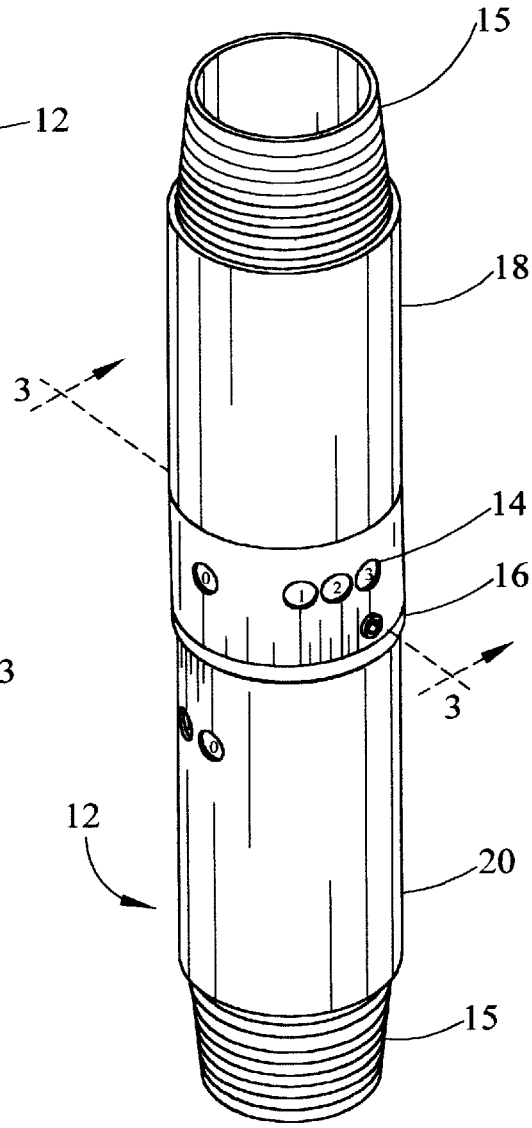
FIG. 2 is an isometric view of the preferred embodiment.

The bent housing assembly 10, better seen in FIG. 2, may have externally threaded pin ends 15 as shown, box ends, or a combination of the two as generally used in the field to adapt the bent housing 10 to the bearing assembly 13 and motor housing 17. Large, well identified adjustment indicia 14 is engraved on the first body member 20 adjacent the shoulder 22 indicating 0–3 degrees 1 ½ degree increments to facilitate the orientations of the indexing ring 16 relative to the first and second body members 18 and 20 respectively.

Figure 3:
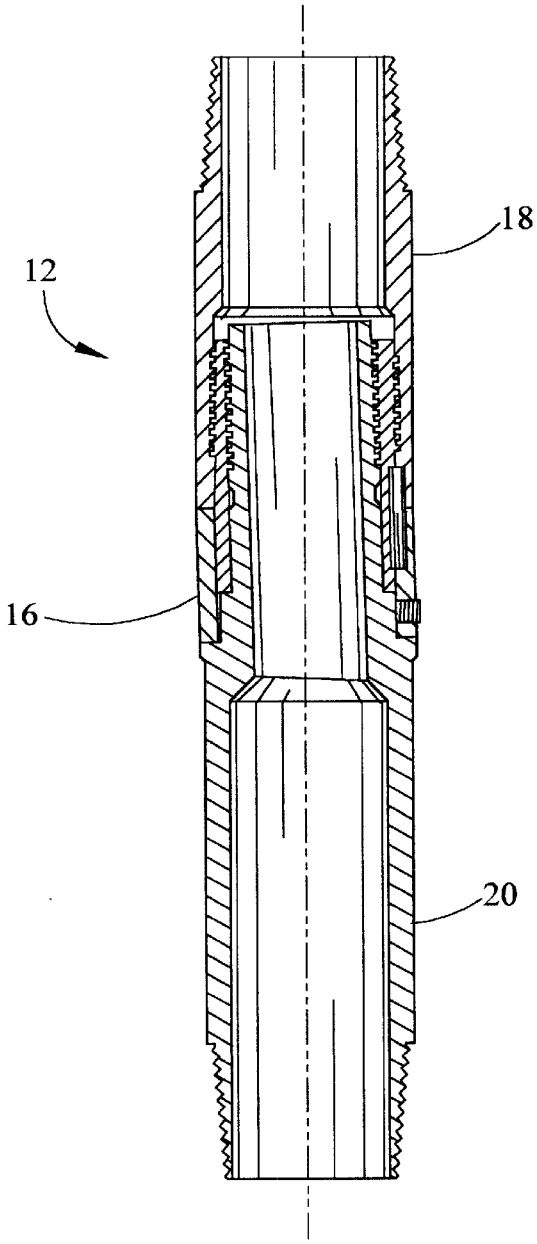
FIG. 3 is a cross section view taken along sight line 3—3 seen in FIG. 2 of the preferred embodiment at zero offset.
Figure 4:
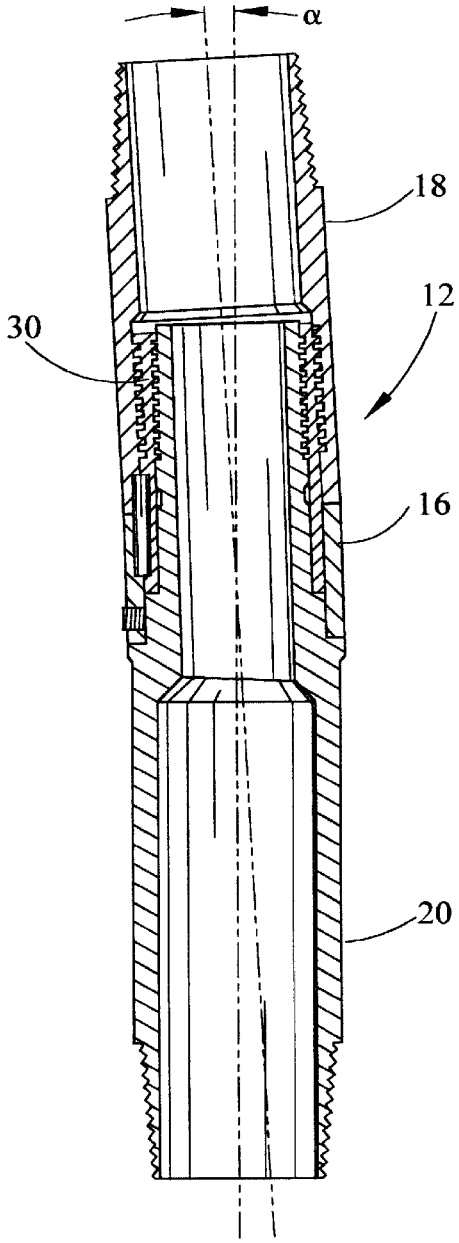
FIG. 4 is cross section view taken along sight line 3—3 seen in FIG. 2 of the preferred embodiment at max offset.

As seen in FIG. 3, the sub body members 18 and 20 are rotationally aligned internally and externally in the neutral position with zero offset, whereas body member 18 may be offset both internally and externally relative to body member 20 by angle $\alpha$ as a result of simply adjusting the indexing ring 16 as seen in FIG. 4. As further seen in FIG. 4, the central axis of body member 18 is rotationally processional about the central axis of the body member 20 by the angle $\alpha$ set by positioning of the eccentric sleeve 30.

Figure 5:
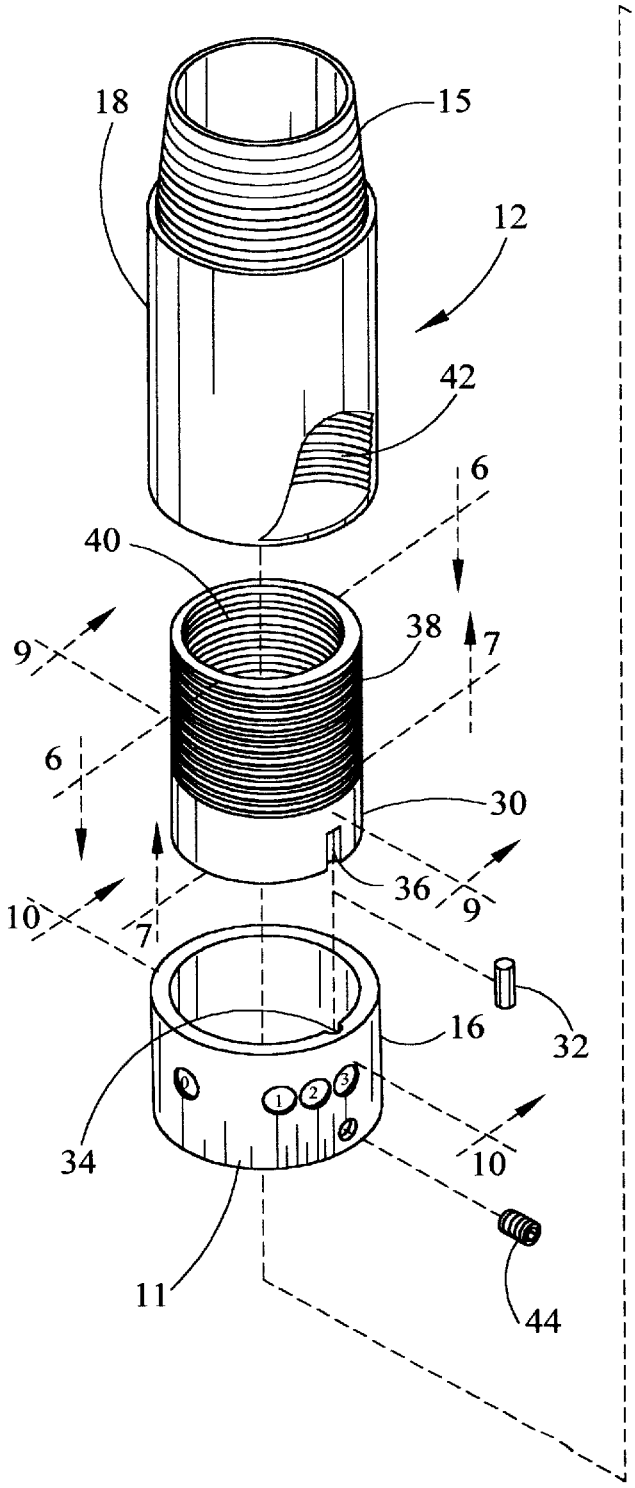
FIG. 5 is an exploded view of the preferred embodiment.

Turning now to the exploded view of FIG. 5, we see the nomenclature of the bent housing assembly includes a first body member 20 having a tapered pipe threaded pin end 15, a shoulder portion 22, a stepped down mandrel portion 24, and an externally threaded portion 26, an indexing sleeve 16, slidable upon and rotatable about shoulder 22, an eccentric sleeve 30 being partially externally and internally threaded 38 and 40 respectively for cooperative threaded engagement with the threaded portion 26 of the mandrel portion 24, and keyed externally to the indexing sleeve 16 with a key 32 residing and captured within key ways 34 and 36 in the indexing sleeve 16 and the eccentric sleeve 30, and a second body portion 18 also having tapered pipe threaded pin end 15 and being internally threaded for cooperative threaded engagement with the external threads 38 of the eccentric sleeve 30. Body members 18 and 20 are centrally bored to allow passage of the mud motor's drive shaft and for clear flow of mud along a central axis running longitudinally through the bent housing 10. Indicia 14 is provided on the indexing sleeve 16 corresponding to indicia engraved on the adjacent body member 20 with markings in one-quarter degree increments for orientation reference between zero and three degrees. However, it is anticipated that greater angularity may be achieved if desired. Indicia markings are precision orientated to coincide with the maximum point of eccentricity of the eccentric sleeve 30 with alignment maintained between the eccentric sleeve and the indexing sleeve by the key 32. A set screw 44 is threaded into the indexing sleeve 16 for locking the indexing sleeve relative to the shoulder 22 of the first body member 20 during make up of the threads. Indentations may also be provided in the shoulder 22 to insure a positive grip of the setscrew 44.

Figure 6:
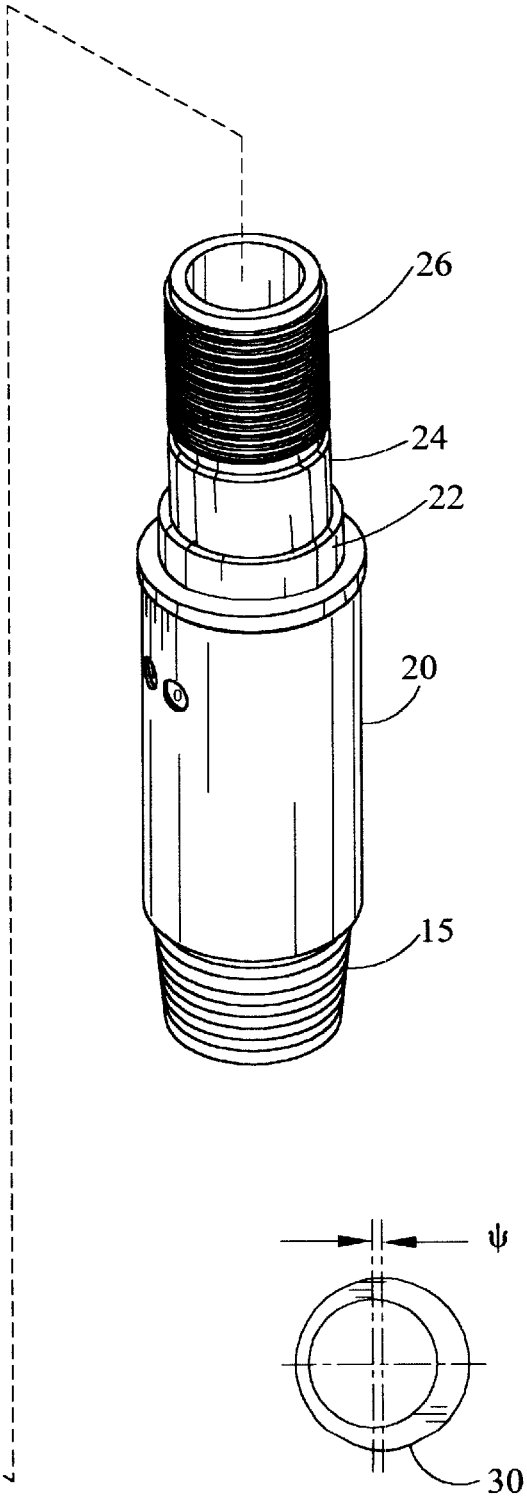
FIG. 6 is an end view of the eccentric sleeve taken along sight line 6—6 seen in FIG. 5.
Figure 7:
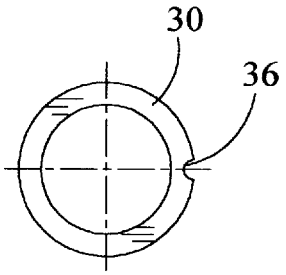
FIG. 7 is an end view of the eccentric sleeve taken along sight line 7—7 seen in FIG. 5.
Figure 9:
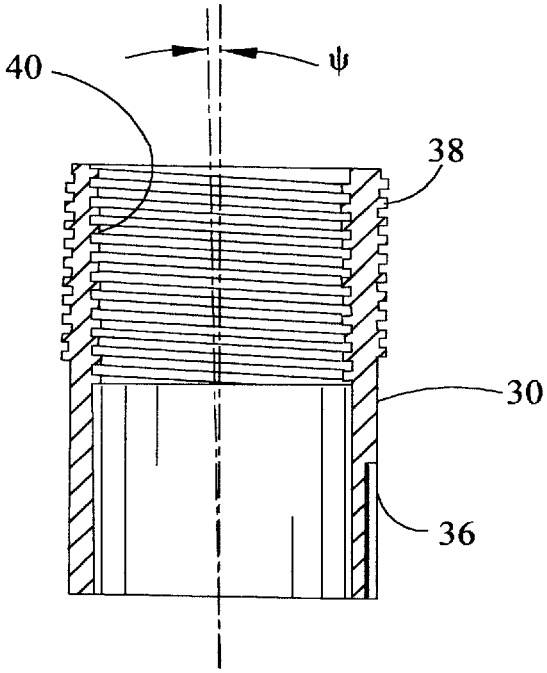
FIG. 9 is a cross section view of the eccentric sleeve as viewed along sight lines 9—9 seen in FIG. 5.
Figure 10:
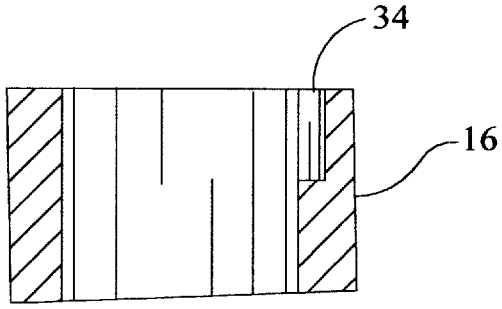
FIG. 10 is a cross section view of the indexing sleeve as viewed along sight line 10—10 seen in FIG. 5.

As also seen in FIGS. 6, 7, and 9, the eccentric sleeve is centrally bored at an offset angle $\Psi$ from the central axis. Therefore one end is eccentric as seen in FIG. 6 while the opposite end is concentric as seen in FIG. 7 and better seen in cross section in FIG. 9.

Figure 8:
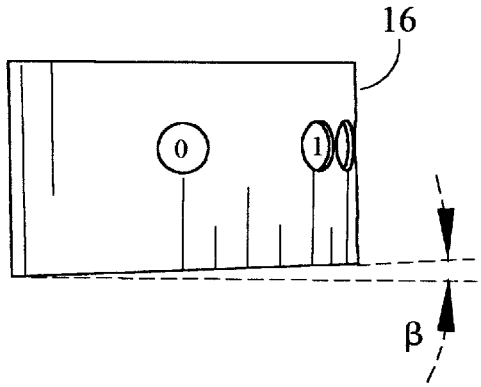
FIG. 8 is a front elevation view of the indexing sleeve.

As seen in FIG. 8, one end of the indexing sleeve 16 is truncated by an angle $\beta$ and therefore faced non-parallel to the opposite end thereby allowing for eccentric offsetting of the first and second body members 18, 20 relative to each other.

Indexing is accomplished by releasing the setscrew 44 and backing off the second body member 18 from its threaded engagement with the eccentric sleeve 30 and shouldered contact with the indexing sleeve 16. This allows the indexing sleeve 16 and the eccentric sleeve 30 to become rotatable relative to the mandrel portion 24.

The disclosed bent housing operates on the principle of opposing bend angles between zero and maximum concentricity. Therefore, each of the housing's body members 18 and 20 has its own bend plane with central axis that may be aligned or opposed. Therefore, by rotating the two body members independently relative to an eccentric sleeve 16, a relatively small rotational adjustment of the indexing sleeve 16 relative to the first body member 20 results in an infinite angular offset of the second body member 18. However, rotation of both body members 18 and 20 relative to the indexing sleeve 14 in opposite directions results in a compound angle. When the desired degree of offset is set by rotating the indexing sleeve 16 according to the indicia, tightening the second body member 18 relative to the first body member 20 resets the sub assembly 10 to the new angle.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An adjustable bent housing comprising:

a) an elongated cylindrical first body member having an internal longitudinal bore and a mandrel portion at one end comprising a shoulder portion and a threaded portion;

b) an indexing sleeve having an internal key slot at one end, said indexing sleeve slidable upon and rotatable about said shoulder portion;

c) an eccentric sleeve having internal and external threads and an external key slot at one end, said internal threads engaging said threaded portion in a manner whereby a portion of said eccentric sleeve extends within said indexing sleeve;

d) a key inserted into the key slot in said indexing sleeve and said eccentric sleeve and captured therein on assembly; and e) an elongated cylindrical second body member having an internal longitudinal bore and internal threads at one end engaging the external threads of said eccentric sleeve.

2. The adjustable bent housing according to claim 1 wherein an end of said first body member is threadably attachable to a mud motor housing assembly.

3. The adjustable bent housing according to claim 1 wherein an end of said second body member is threadably attachable to a mud motor housing assembly.

4. The adjustable bent housing according to claim 1 wherein said first body member is inscribed with indicia adjacent said shoulder portion indicative of zero through three degrees in one-quarter degree increments.

5. The adjustable bent housing according to claim 4 wherein said indexing sleeve is inscribed with indicia corresponding to said indicia inscribed on said first body member and wherein said indexing sleeve is orientated upon said shoulder portion in a manner whereby said indicia inscribed upon said indexing ring and said first body member are adjacent.

6. The adjustable bent housing according to claim 1 wherein said eccentric sleeve is rotatable upon said mandrel by rotating said indexing ring.

7. The adjustable bent housing according to claim 1 wherein said indexing ring further comprises a retaining means for locking said indexing ring relative to said shoulder portions.

8. The adjustable bent housing according to claim 1 wherein one end of said indexing sleeve is truncated.

9. The adjustable bent housing according to claim 1 wherein the central axis of said second body member is processionally orbital about the central axis of said first body member as a result of rotating said indexing sleeve.

10. The adjustable bent housing according to claim 1 wherein said eccentric sleeve is centrally bored longitudinally at an offset angle relative to the central axis.

11. The adjustable bent housing according to claim 1 wherein said eccentric sleeve is eccentric at one end and concentric at the opposite end.

12. An adjustable bent housing adapter for a mud motor comprising:

a) a first elongated tubular body member having an internal threaded portion;

b) an eccentric sleeve having an external key slot at one end and internal and external threaded portions said external threaded portion engaging internal thread portion of said first elongated tubular body member;

c) an indexing sleeve having an internal key slot at one end corresponding to said key slot in said eccentric sleeve said indexing sleeve slidable upon a portion of said eccentric sleeve;

d) a key captured within said key slot in said eccentric sleeve and said key slot in said indexing ring in a manner whereby said indexing sleeve is in rotatable locked engagement with said eccentric sleeve; and e) a second elongated tubular body member having a shoulder portion and a mandrel portion having external threads engaging internal threads of said eccentric sleeve.

13. The adjustable bent housing adapter according to claim 12 wherein an end of said first and second elongated tubular body members are threadably adaptable to a mud motor housing.

14. The adjustable bent housing adapter according to claim 12 wherein said indexing sleeve and said second elongated tubular body member are engraved with corresponding indicia indicating minimum and maximum angularity between said first and second elongated tubular body members in increments of a fraction of a degree.

15. The adjustable bent housing adapter according to claim 12 wherein said indexing sleeve further comprises a means for locking said indexing ring to said shoulder of said second elongated tubular body member.

16. The adjustable bent housing adapter according to claim 12 wherein one end of said indexing sleeve is truncated.

17. The adjustable bent housing according to claim 12 wherein the central axis of said second body member is processionally orbital about the central axis of said first body member as a result of rotating said indexing sleeve.

18. A method for adjustably orientating a mud motor relative to a drill bit comprising:

a) providing an adjustable bent housing adapter comprising:

i) a first elongated tubular body member having an internal thread portion;

ii) an eccentric sleeve having an external key slot at one end and internal and external threaded portions said external threaded portion engaging internal thread portion of said first elongated tubular body member;

iii) an indexing sleeve having an internal key slot at one end corresponding to said key slot in said eccentric sleeve, said indexing sleeve slidable upon a portion of said eccentric sleeve;

iv) a key captured within said key slot in said eccentric sleeve and said key slot in said indexing ring in a manner whereby said indexing sleeve is in rotatable locked engagement with said eccentric sleeve;

v) a second elongated tubular body member having a shoulder portion and a mandrel portion having external threads engaging internal threads of said eccentric sleeve; and vi) a means for locking said indexing ring to said shoulder portion;

b) coupling said bent housing adapter within a mud motor housing assembly between said drill bit and said mud motor;

c) unlocking said locking means and partially disengaging said first elongated tubular body member from said second elongated tubular body member;

d) rotating said indexing sleeve to a desired angle; and e) re-engaging said first elongated tubular body member with said second elongated tubular body member and locking said locking means.

* * * * *